US005929775A

United States Patent [19]

Tsuchiyama

[11] Patent Number: 5,929,775

[45] Date of Patent: Jul. 27, 1999

[54] RADIO PAGING RECEIVER WITH DISPLAY

[75] Inventor: Kinya Tsuchiyama, Shizuoka, Japan

[73] Assignee: NEC Corporation, Tokyo, Japan

[21] Appl. No.: 08/883,883

[22] Filed: Jun. 27, 1997

[30] Foreign Application Priority Data

Jun. 27, 1996 [JP] Japan ..... 8-168038

[51] Int. Cl.[6] ..... G08B 21/00

[52] U.S. Cl. ..... 340/825.44; 340/636; 455/38.2; 455/38.3; 455/343; 324/426; 320/49

[58] Field of Search ..... 340/825.44, 636, 340/309.15, 311.1, 635; 455/38.2, 38.3, 343; 324/426, 433; 320/49

[56] References Cited

U.S. PATENT DOCUMENTS

| | | | |
|---|---|---|---|
| 4,908,523 | 3/1990 | Snowden et al. | 307/43 |
| 5,032,825 | 7/1991 | Kuznicki | 340/636 |
| 5,095,308 | 3/1992 | Hewitt | 340/825.44 |
| 5,140,310 | 8/1992 | DeLuca et al. | 340/636 |
| 5,218,705 | 6/1993 | DeLuca et al. | 395/750 |
| 5,304,986 | 4/1994 | Motegi | 340/636 |
| 5,365,221 | 11/1994 | Fennell et al. | 340/636 |
| 5,424,721 | 6/1995 | Asai | 340/636 |
| 5,442,345 | 8/1995 | Kwon | 340/825.46 |
| 5,684,404 | 11/1997 | Millar | 324/426 |

FOREIGN PATENT DOCUMENTS

| | | |
|---|---|---|
| 3-248636 | 11/1991 | Japan . |
| 5-48515 | 2/1993 | Japan . |
| WO 90/13189 | 11/1990 | WIPO . |
| WO 96/20532 | 7/1996 | WIPO . |

OTHER PUBLICATIONS

Patent Abstracts of Japan, vol. 16, No. 45 (E–1162), Publication No. JP 03 248636 A (Nov. 6, 1991).

Rudy et al., "Pager–Off Alert and Recovery Protection," Motorola Technical Developments, vol. 15, p. 57 (May 1992).

*Primary Examiner*—William A. Cuchlinski, Jr.
*Assistant Examiner*—Yonel Beaulieu
*Attorney, Agent, or Firm*—Scully, Scott, Murphy and Presser

[57] ABSTRACT

A radio paging receiver capable of giving an intense impact to a user so as to stimulate the user to exchange a cell and to prevent a negligence of the cell exchange and preventing an inoperative receiving due to a source voltage drop and a cleared state of a backup device for received information. A low voltage detector monitors a source voltage Va of the cell, and, when the source voltage Va falls below a reference voltage, the low voltage detector outputs a low voltage detection signal to a logic. The logic starts a countdown of a predetermined time from the time when the low voltage detection signal is detected. The logic then controls an informing part to inform of an alarm and a display means to display the countdown of the remaining time thereon up to a power off. Further, the logic compulsorily cuts the power when the predetermined time has passed.

12 Claims, 10 Drawing Sheets

FIG. 8A

LVA SETTING MENU

1 :DISPLAY SETTING
2 :INFORMING MEANS SETTING
3 :INFORMING INTERVAL SETTING

FIG. 8B

DISPLAY SETTING SELECTION SCREEN

WHOLE DISPLAY  PART DISPLAY

FIG. 8C

INFORMING MEANS SELECTION SCREEN

SPEAKER  VIBRATION MOTOR

FIG. 8D

INFORMING INTERVAL SELECTION SCREEN

INFORMING EVERY 12 HOURS
INFORMING EVERY 6 HOURS
INFORMING EVERY 1 HOUR

RADIO PAGING RECEIVER WITH DISPLAY

BACKGROUND OF THE INVENTION

The present invention relates to a radio paging receiver with a display to inform of a radio paging from a base station and to display a message accompanied by the radio paging, and more particularly to a radio paging receiver with a display and a lower voltage alarm for informing of a countdown until a predetermined time lapses from a detection of a source voltage drop.

DESCRIPTION OF THE RELATED ART

Conventionally, a plurality of radio paging receivers with a display ("receivers" hereinafter) such as radio pagers capable of informing of a call or a radio paging transmitted from a base station via a radio wave and simultaneously displaying a message or the like accompanied by the radio paging have been developed. Some examples of the receivers of this kind, for example, are disclosed in Japanese Patent Laid-Open Publication No. 3-248636 (entitled "Individual Radio Paging Receiver" and Japanese Patent Laid-Open Publication No. 5-48515 (entitled "Radio Paging Receiver".

The receivers described in these documents are provided with a lower voltage alarm ("LVA" hereinafter). When a cell voltage (electric source voltage) of the receiver falls below a reference voltage, the LVA gives a warning to a user to let him exchange the cell in order to prevent the receiver from falling into an inoperative state.

FIGS. 1A and 1B show one example of a warning display in the display screen of the receiver. For example, at a normal source voltage, while awaiting a radio paging, the receiver displays a date, a time and the like in its screen, as shown in FIG. 1A. When detecting a lower voltage ("LV" hereinafter) than the reference source voltage, a symbol indicating the LV state is displayed in the lower right side in the display screen, as shown in FIG. 1B.

Some warning means of the LV state have been known. For example, an LV symbol is turned on or flashed in the display screen such as a liquid crystal display ("LCD" hereinafter), as shown in FIG. 1B. Alternatively, the user can be informed of the LV state by a sound using a speaker, by a vibration using a vibration motor, or by turning on or flashing an LED (light emitting diode).

In the conventional receivers, as described above, a warning is adapted to be given when the source voltage falls below the reference voltage. However, in such receivers, even when the user is informed of the LV state, a logic part, a radio part for receiving a transmission signal from the base station and so forth constituting the receiver are adapted to keep their normal operations in a predetermined period after the informing.

Moreover, even when the progress of the LV state brings about an unstable operation of the radio part, no change in function is apparent. Hence, the user is illusionary that the receiver still operates normally. As a result, the cell of the receiver is liable to be exhausted towards its inoperative state.

In such informing means, the impact made on the user is weak, and the user is informed of the LV state only when the cell exchange is desired, often resulting in causing an inoperative state of the receiver. When the cell is not exchanged and the cell exchange chance is lost, the electric source turns off without being aware. As a result, even if the receiver has a backup device for the received information, the backup device may fall into a cleared state.

SUMMARY OF THE INVENTION

It is therefore an object of the present invention to provide a radio paging receiver with a display in view of the aforementioned disadvantages of the prior art, which is capable of giving an intense impact to a user so as to stimulate the user to exchange a cell and to prevent a negligence of the cell exchange, and preventing an inoperative receiving due to a source voltage fall and a cleared state of a backup device for received information.

In accordance with one aspect of the present invention, there is provided a radio paging receiver with a display, comprising low voltage detecting means for detecting a voltage drop of a power source; alarm means for alarming when the voltage drop of the power source is detected; time counting means for counting time of a clock; time counting control means for making the time counting means start the time counting when the voltage drop of the power source is detected and for detecting a predetermined time lapse from the start of the time counting; and power source control means for cutting the power source when the predetermined time lapse is detected in the case that the power source is not turned off and is not removed.

Preferably, a radio paging receiver further comprises first informing means for informing of a value of the predetermined time when the voltage drop of the power source is detected.

A radio paging receiver can further comprise calculating means for calculating remaining time before the predetermined time lapse on the basis of the time counted by the time counting means; and second informing means for informing of the remaining time.

In a radio paging receiver, preferably, the second informing means displays the remaining time on a display means within a display range specified from outside.

A radio paging receiver can further comprise third informing means for informing of an alarm of the voltage drop of the power source from the time of the voltage drop detection every predetermined time interval, and the third informing means carries out the alarm informing according to a time interval specified from outside and a specification of informing equipment.

BRIEF DESCRIPTION OF THE DRAWINGS

The objects, features and advantages of the present invention will become more apparent from the consideration of the following detailed description, taken in conjunction with the accompanying drawings, in which:

FIG. 8A, FIG. 8B, FIG. 8C and FIG. 8D are schematic diagrams of a display screen in the setting, showing an LVA setting menu screen, a display setting selection screen, an informing means selection screen, and an informing interval selection screen, respectively;

DESCRIPTION OF THE PREFERRED EMBODIMENTS

Figure 2:
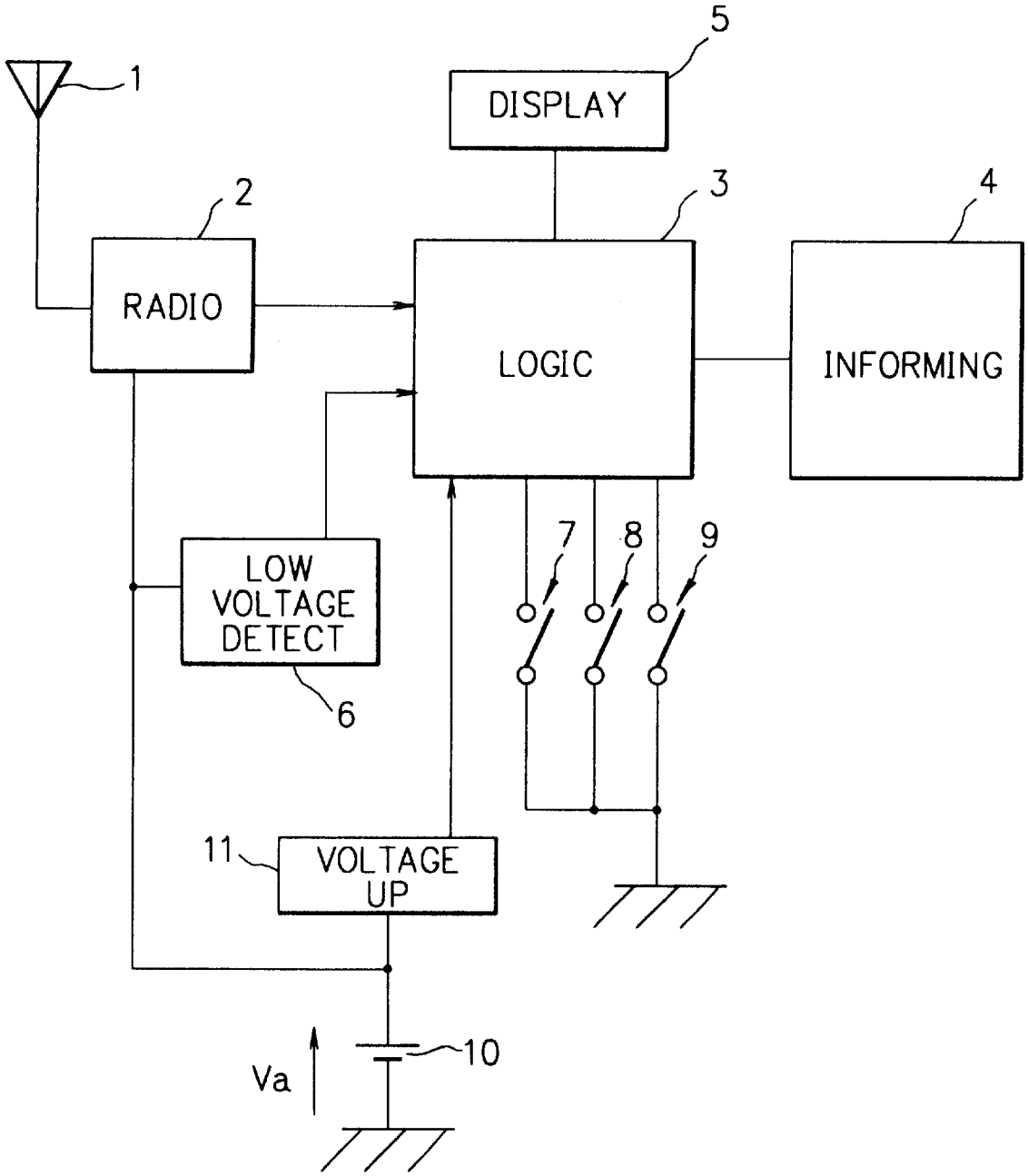
FIG. 2 is a block diagram of a radio paging receiver with a display according to one embodiment of the present invention.

Referring now to the drawings, there is shown in FIG. 2 a radio paging receiver with a display according to one embodiment of the present invention.

In FIG. 2, an antenna 1 receives a radio wave transmitted from a base station (not shown) and transfers the transmission signal to a radio part 2. The radio part 2 receives the transmission signal and demodulates the received signal to output the demodulated signal. The radio part 2 is supplied with a source voltage Va from a cell 10 as an electric source.

Figure 1A:
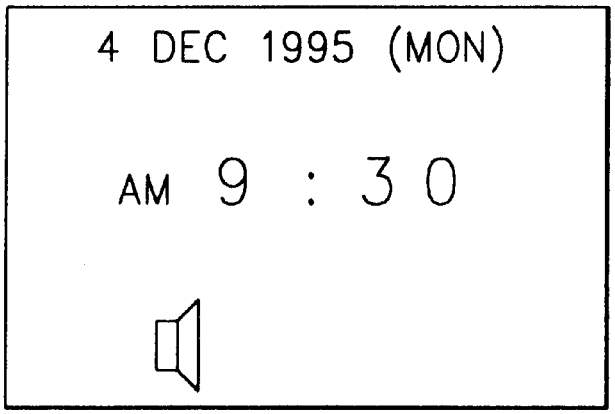
FIG. 1A PRIOR ART
FIG. 1A and FIG. 1B are schematic diagrams showing a display screen of a conventional radio paging receiver with a display when waiting for a receiving of a radio paging and a display screen of the same when a lower voltage alarm functions.
Figure 1B:
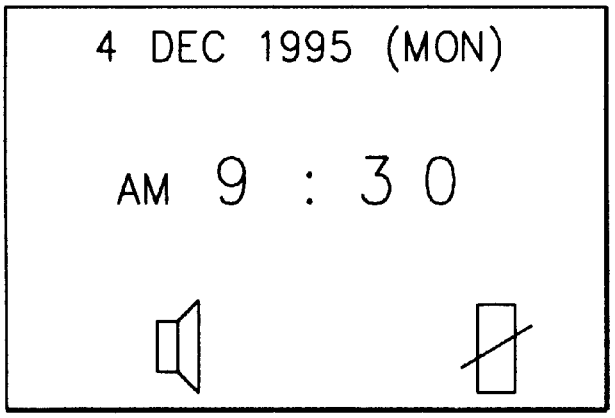
FIG. 1B PRIOR ART

A logic 3 is the central part for controlling the other parts in the receiver and its function will be described with reference to the explanation of the operation of the receiver. An informing part 4 informs a user of a radio paging by means of turning on or flashing an LED, a sound, vibration or the like. In this embodiment, the receiver includes a speaker and a vibration motor. A display 5 is constituted by a display means such as an LCD or the like and displays various characters and symbols in its screen according to an instruction from the logic 3. For example, in the display 5, besides a date and a time, as shown in FIGS. 1A and 1B, a message transmitted with a radio paging, various information concerning an LVA (lower voltage alarm), and a menu screen for setting various values of the LVA are displayed. A low voltage detector 6 monitors a source voltage Va of the cell 10, and, when the source voltage Va drops below a reference voltage generated within the low voltage detector 6, the low voltage detector 6 outputs a low voltage detection signal to the logic 3.

A first switch 7 is a menu switch for entering a menu mode for setting various functions. When entering the menu mode, various settings for the receiver can be carried out while looking at a menu shown in the display 5. On the other hand, in the menu mode, when pushing down the first switch 7, the display 5 can be returned to the previous screen.

A second switch 8 determines selections item by item on the menu shown in the display 5 when entering the menu mode. When pushing down the second switch 8 in awaiting the receiving, the messages stored in the receiver can be read out in order from the oldest one to the latest one.

A third switch 9 changes the items one by one on the menu shown in the display 5 for selecting when entering the menu mode. When pushing down the third switch 9, on the contrary to the pushing down of the second switch 8, the messages stored in the receiver can be read out in order from the latest one to the oldest one. As described above, by pushing down the second switch 8 or the third switch 9, the user can read out the messages at any time.

The first, second and third switches 7 to 9 are adapted to output an "L" (low) level signal to the logic 3 at their on-state and a "H" (high) level signal to the logic 3 at their off-state.

The cell 10 as an electric source applies the source voltage Va to the radio part 2, the low voltage detector 6 and a voltage up part 11. The voltage up part 11 raises the source voltage Va applied from the cell 10 to supply a suitable voltage to the logic 3.

Figure 3:
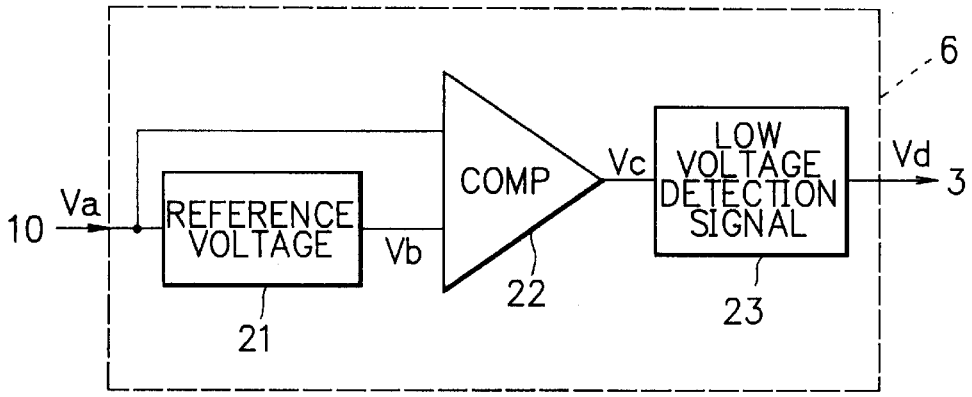
FIG. 3 is a block diagram of a low voltage detector of the radio paging receiver shown in FIG. 2.

FIG. 3 shows one embodiment of the low voltage detector 6 shown in FIG. 2. In FIG. 3, the source voltage Va applied from the cell 10 is supplied to a reference voltage generator 21 and a comparator 22. The reference voltage generator 21 generates a certain reference voltage Vb for detecting an LV (lower voltage) than the reference voltage on the basis of the source voltage Va and outputs the reference voltage Vb to the comparator 22.

The comparator 22 compares the reference voltage Vb with the source voltage Va to output a resulted signal Vc to a low voltage detection signal generator 23. The output signal Vc is controlled to be the high level when the source voltage Va is higher than the reference voltage Vb and to be the low level when the former is lower than the latter. The low voltage detection signal generator 23 generates a low voltage detection signal Vd when the output signal Vc falls low level.

Figure 4:
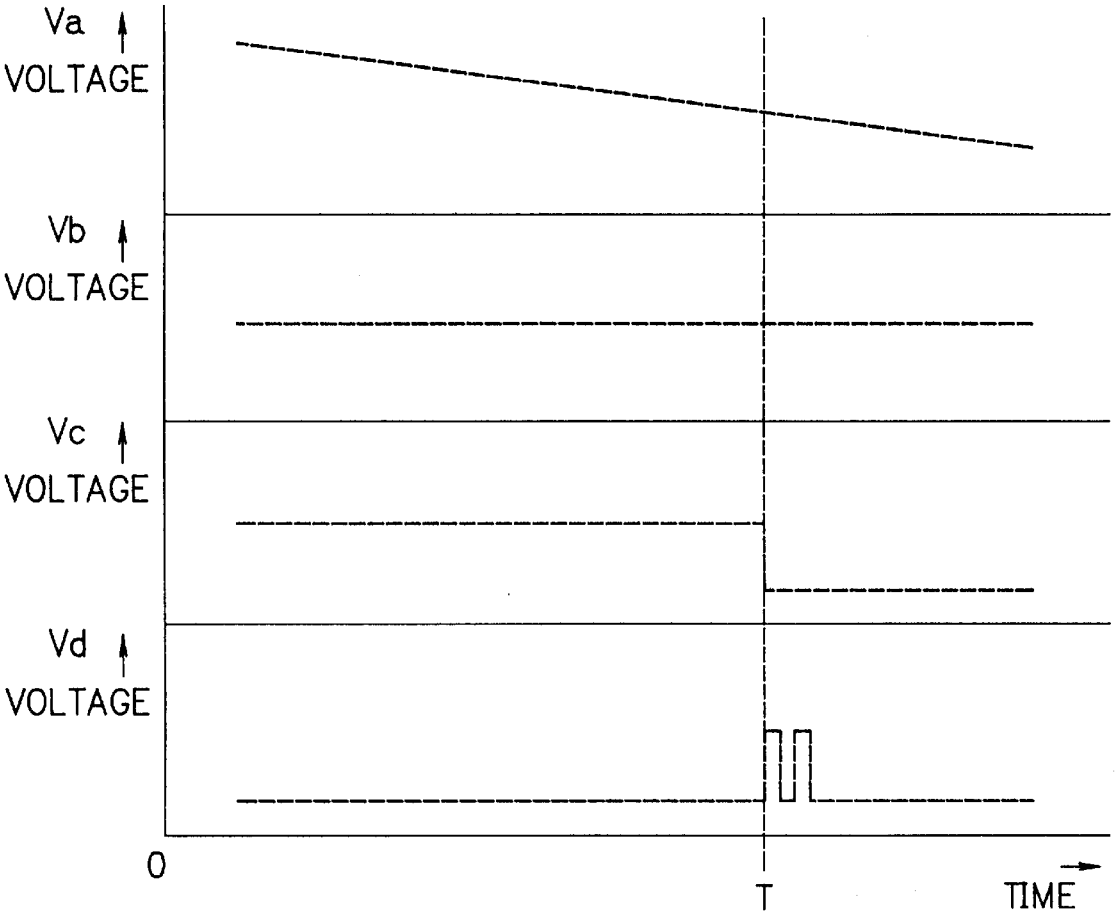
FIG. 4 is a timing chart showing a timing for generating a lower voltage detection signal in the radio paging receiver shown in FIG. 2.

FIG. 4 shows variation of the reference voltage Vb, the output signal Vc and the low voltage detection signal Vd as the source voltage Va of the cell 10 lowers. In FIG. 4, the source voltage Va gradually falls from the time "0" when a power switch is turned on. When a time T has passed from the time "0", the source voltage Va turns lower than the reference voltage Vb, and the output signal Vc has changed from the high level to the low level, generating the low voltage detection signal Vd.

Figure 5:
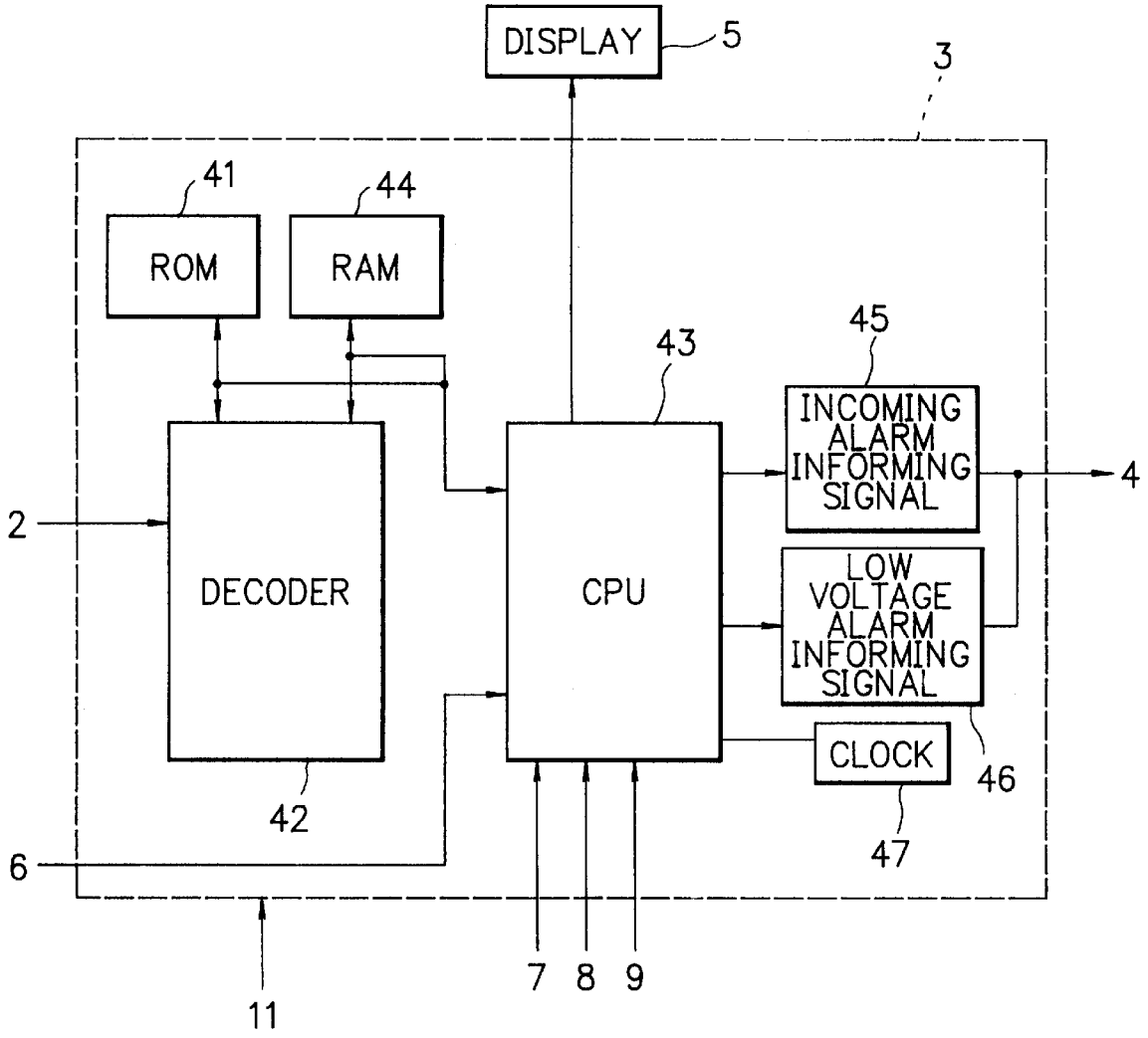
FIG. 5 is a block diagram of a logic shown in FIG. 2.

FIG. 5 illustrates one embodiment of the logic 3 shown in FIG. 2. In FIG. 5, a ROM (read only memory) 41 stores specific individual ID numbers previously given every receiver. A decoder 42 compares an individual ID signal included in the transmission signal sent from the radio part 2 with the individual ID numbers stored in the ROM 41, and, when the two members are coincident with each other, the decoder 42 outputs an incoming signal to a CPU (central processing unit) 43. In the case that a message signal follows the individual ID signal given by the radio part 2, the decoder 42 detects this signal and transfers the message signal to the CPU 43.

The CPU 43 controls the other parts of the logic part 3. When receiving the incoming signal from the decoder 42, the CPU 43 commands an incoming alarm informing signal generator 45 to generate an incoming informing signal. Further, when receiving the message signal from the decoder 42, the CPU 43 converts the message signal into a character font signal and outputs the character font signal to the display 5 for displaying the message. Simultaneously, the CPU 43 stores the message into a RAM (random access memory) 44.

Moreover, the CPU 43 always monitors the states of the switches 7 to 9 and detects the change of the logic level at the input terminals of the switches 7 to 9 from the high level to the low level to detect the push-down of the switches. The incoming alarm informing signal generator 45 outputs the incoming informing signal to the informing part 4 according to the command output from the CPU 43.

When the CPU 43 receives the low voltage detection signal Vd from the low voltage detector 6, a low voltage alarm informing signal generator 46 generates a low voltage alarm informing signal at a predetermined pattern according to a command of the CPU 43. A clock 47 of a general timer carries out a time counting and is used for processing of the countdown of the remaining time up to a power off, as described hereinafter.

Next, an operation of the radio paging receiver with the display described above will be described.

Before using the receiver, a setting of the LVA will be carried out while the user looks at the display 5. The setting items such as a display mode, an informing means, and an informing interval are given.

Figure 6:
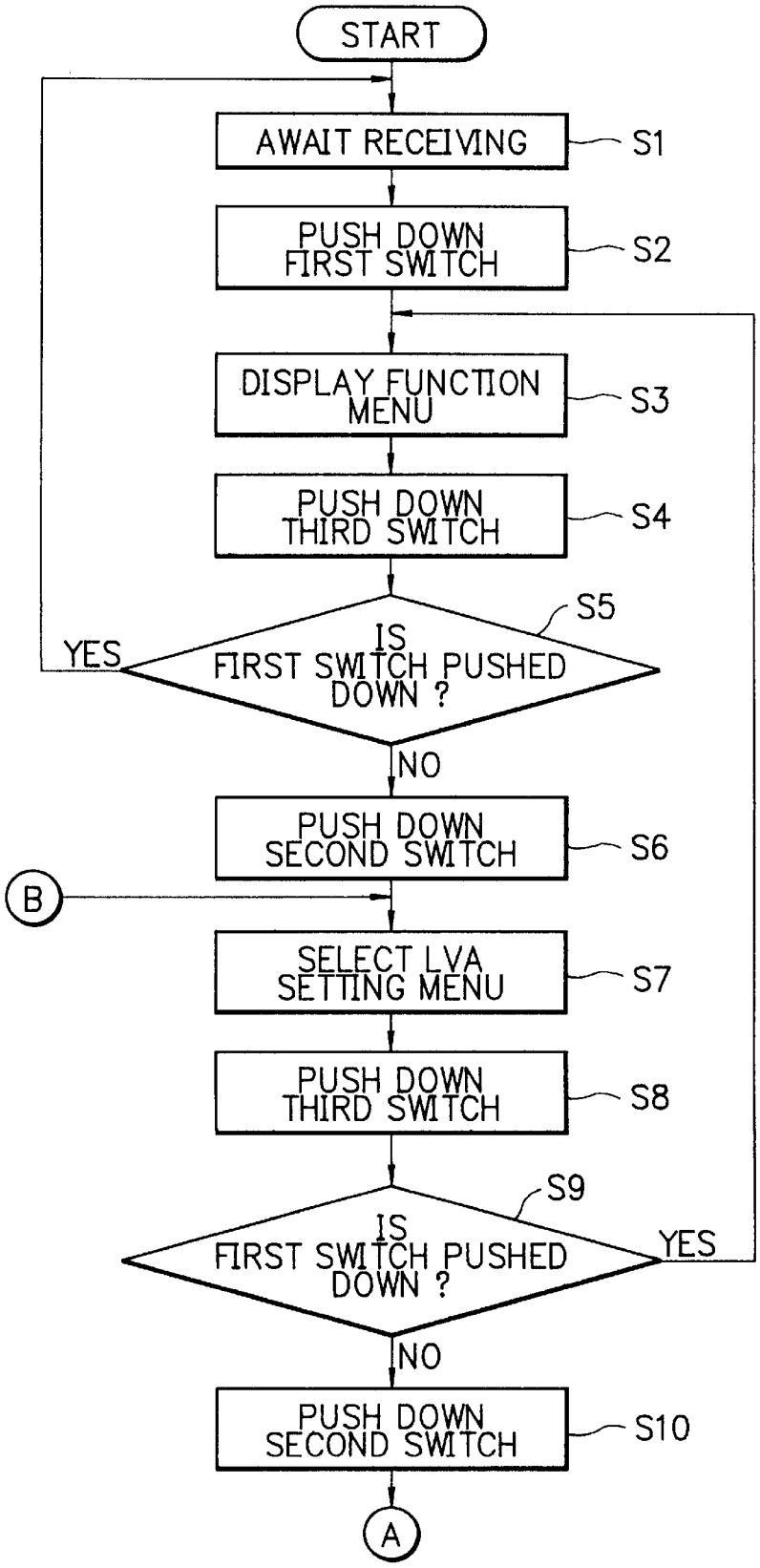
FIGS. 6 and 7 are flow charts showing a process for setting a lower voltage alarm (LVA) according to the present invention.
Figure 7:
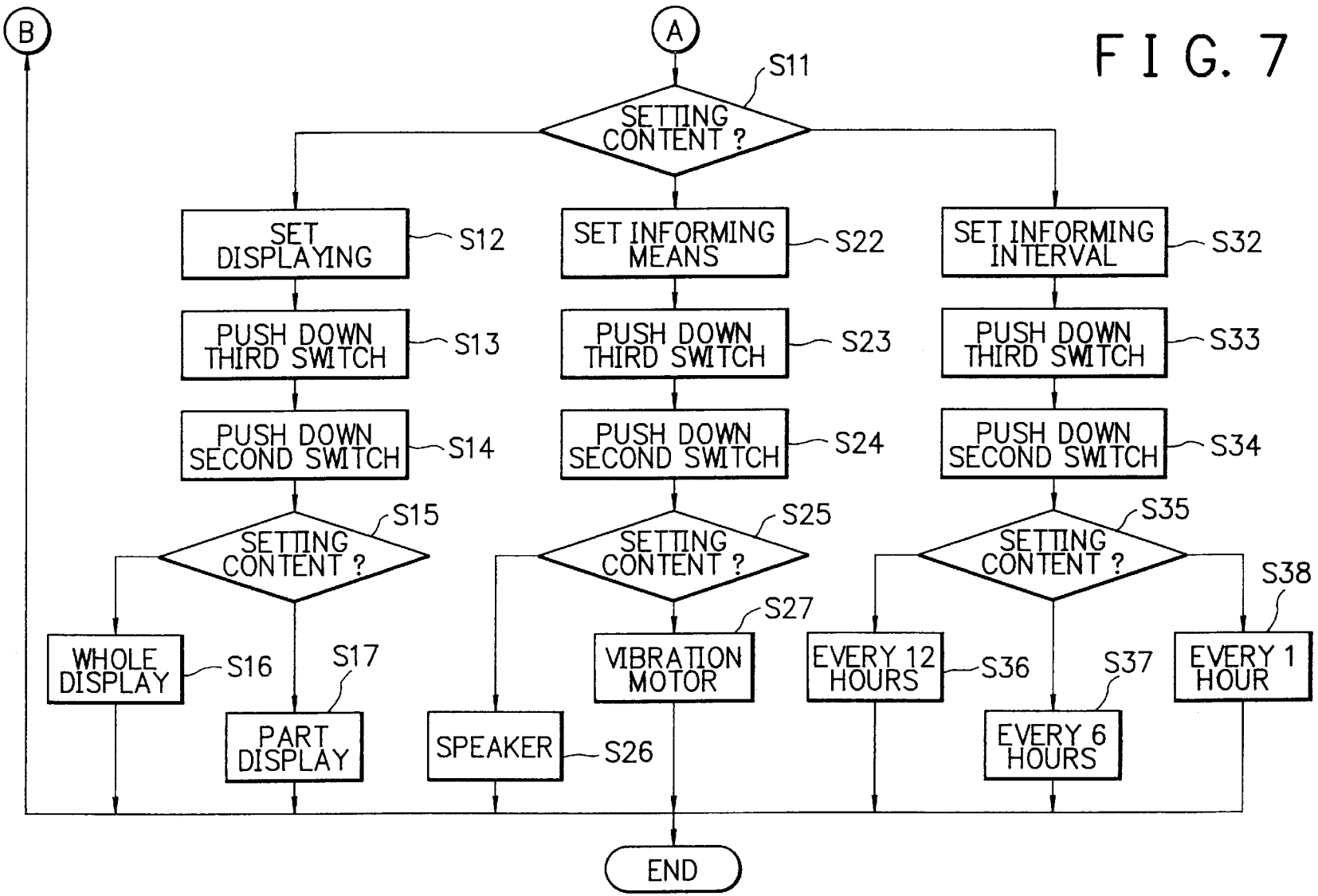

FIGS. 6 and 7 show a setting process of the LVA, and FIGS. 8A to 8D show one example of the screen displays on the display 5 at the setting.

First, a power switch is turned on, and the logic 3 starts awaiting of a receiving from a transmitter of a base station in step S1. In the awaiting of the receiving, the first switch 7 is pushed down in step S2, and the CPU 43 displays a function menu (not shown) on the display 5 in step S3. In order to select menu items on the function menu, the user pushes down the third switch 9 the required times to select the desired menu item in step S4. At this time, when the user pushes down the first switch 7, the setting is interrupted to return to the receiving awaiting process of step S1 in step S5.

On the other hand, when the first switch 7 is not pushed down in step S5, the LVA setting menu for executing the various setting on the LVA is selected on the function menu. In this case, the user pushes down the second switch 8 in step S6, and the selection of the LVA setting menu is determined to display a selection screen of an LVA setting menu shown in FIG. 8 in step S7. On this LVA setting menu, as shown in FIG. 8, one of a display setting (1), an informing means setting (2), and an informing interval setting (3) can be selected.

The user selects one of these selection items by pushing down the third switch 9 proper times in step S8. At this time, when the user pushes down the first switch 7, the setting is interrupted to return to the function menu of step S3 in step 9.

On the other hand, when the first switch 7 is not pushed down, the user selects the "display setting" on the LVA setting menu and pushes down the second switch 8 in step S10, resulting in determining of the selection. The CPU 43 discriminates which item is selected in step S11 to display a display setting selection screen shown in FIG. 8B in step S12.

In this display setting selection screen, as shown in FIG. 8B, either a whole display or a part display can be selected. Now, assuming that the whole display is selected by pushing down the third switch 9 in step S13, the second switch 8 is pushed down for determing the selection in step S14, with the result of the whole display determination. The CPU 43 discriminates this selection in step S15 and executes the whole display determination in step S16. On the other hand, when the part display is selected by pushing down the third switch 9 in step S13, the part display selection is determined by pushing down the second switch 8 in step S14. The CPU 43 then discriminates this selection in step S15 and determines the part display in step S17. Thereafter, regardless of the content of the display setting, the process is returned to the selection of the LVA setting menu shown in FIG. 8A (of step S7).

Alternatively, when the user selects the "informing means setting" on the LVA setting menu in step S8, similarly, an informing means selection screen shown in FIG. 8C is displayed in the display 5 in step S22. In this informing means setting screen, one of an alarm informing using a speaker and an alarm informing using a vibration motor can be selected.

When the user selects the speaker by pushing down the third switch 9 in step S23, the second switch 8 is pushed down to determine the speaker selection in step S24. The CPU 43 discriminates which of the speaker and the vibration motor is selected in step S25 and determines the alarm informing using the speaker in step S26. Thereafter, similarly, the process is returned to the selection of the LVA setting menu shown in FIG. 8A (of step S7). On the other hand, when the vibration motor is selected by pushing down the third switch 9 in step 23, the second switch 8 is pushed down to determine the vibration motor selection in step S24. The CPU 43 discriminates the vibration motor in step S25 and determines the alarm informing using the vibration motor in step S27. Thereafter, similarly, regardless of the content of the display setting, the process is returned to the selection of the LVA setting menu shown in FIG. 8A (of step S7).

On the other hand, when the user selects the "informing interval setting" on the LVA setting menu in step S8, similarly, an informing interval selection screen shown in FIG. 8D is displayed in the display 5 in step S32. In this informing interval selection screen, one of alarm informing intervals every 12 hours, every 6 hours, and every one hour can be selected. When the user selects the informing every 12 hours by pushing down the third switch 9 in step S33, the second switch 8 is pushed down to determine this selection in step S34. Similarly, the CPU 43 discriminates the selection in step S35, and determines the informing interval every 12 hours in step S36. Thereafter, similarly, the process is returned to the selection of the LVA setting menu shown in FIG. 8A (of step S7).

Similarly, on the other hand, when the informing interval every 6 hours or every one hour is selected by pushing down the third switch 9 in step 33, the second switch 8 is pushed down to determine this selection in step S34. The CPU 43 discriminates the informing interval every 6 hours or every one hour in step S35 and determines the informing interval every 6 hours or every one hour in step S37 or step S38. Thereafter, similarly, regardless of the content of the display setting, the process is returned to the selection of the LVA setting menu shown in FIG. 8A (of step S7).

Figure 9A:
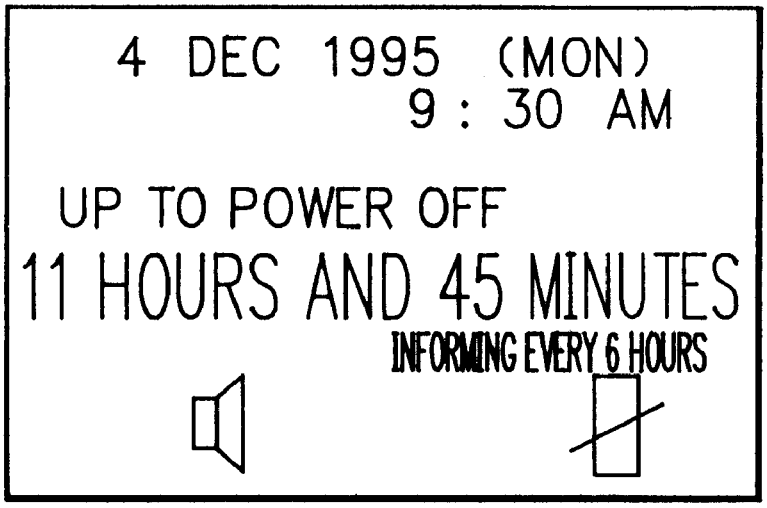
FIG. 9A and FIG. 9B are schematic diagrams of a display screen during a countdown in the setting, showing a whole display of an informing using a speaker every 6 hours (9A), and a part display of an informing using a vibration motor every one hour (9B)
Figure 9B:
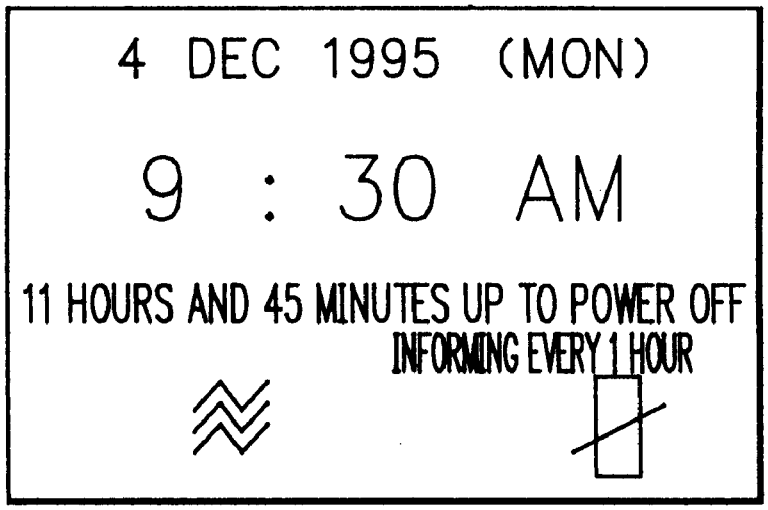

How the foregoing settings concerning the LVA are reflected in the screen of the display 5 will be described. FIG. 9A and FIG. 9B show one example of the screen displayed on the display 5 when the LVA is operated to start a countdown. First, FIG. 9A shows setting contents such as the whole display and an informing every 6 hours using a speaker and that there are 11 hours and 45 minutes up to the power off with the present date and time such as at 9:30 a.m. on Dec. 4, 1995 (monday). As shown in FIG. 9A, in the whole display, the time by the power off is displayed in large compared with the present date and time. Further, in the informing using the speaker, a symbol representing a speaker is shown in the lower left side.

On the other hand, FIG. 9B shows setting contents such as a part display and an informing every one hour using a vibration motor. The time up to the power off and the present date and time are displayed in the same manner as those in FIG. 9A. In the part display, as shown in FIG. 9B, the present time is displayed in large compared with the time up to the power off and the present date. In the informing using the vibration motor, a symbol indicating the vibration is shown in the lower left side in the screen.

Figure 10:
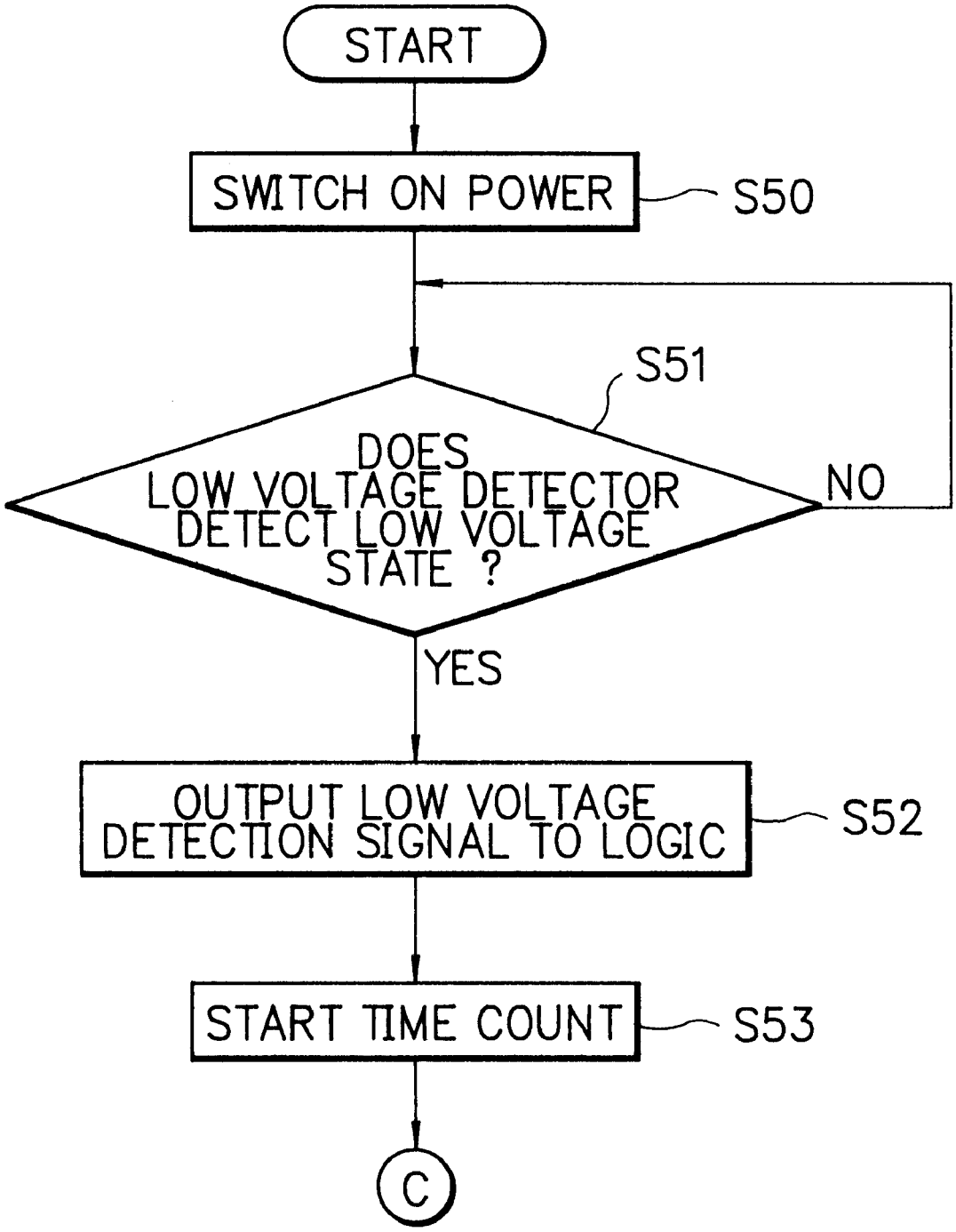
FIG. 10 and FIG. 11 are flow charts showing an operation of the radio paging receiver according to the present invention.
Figure 11:
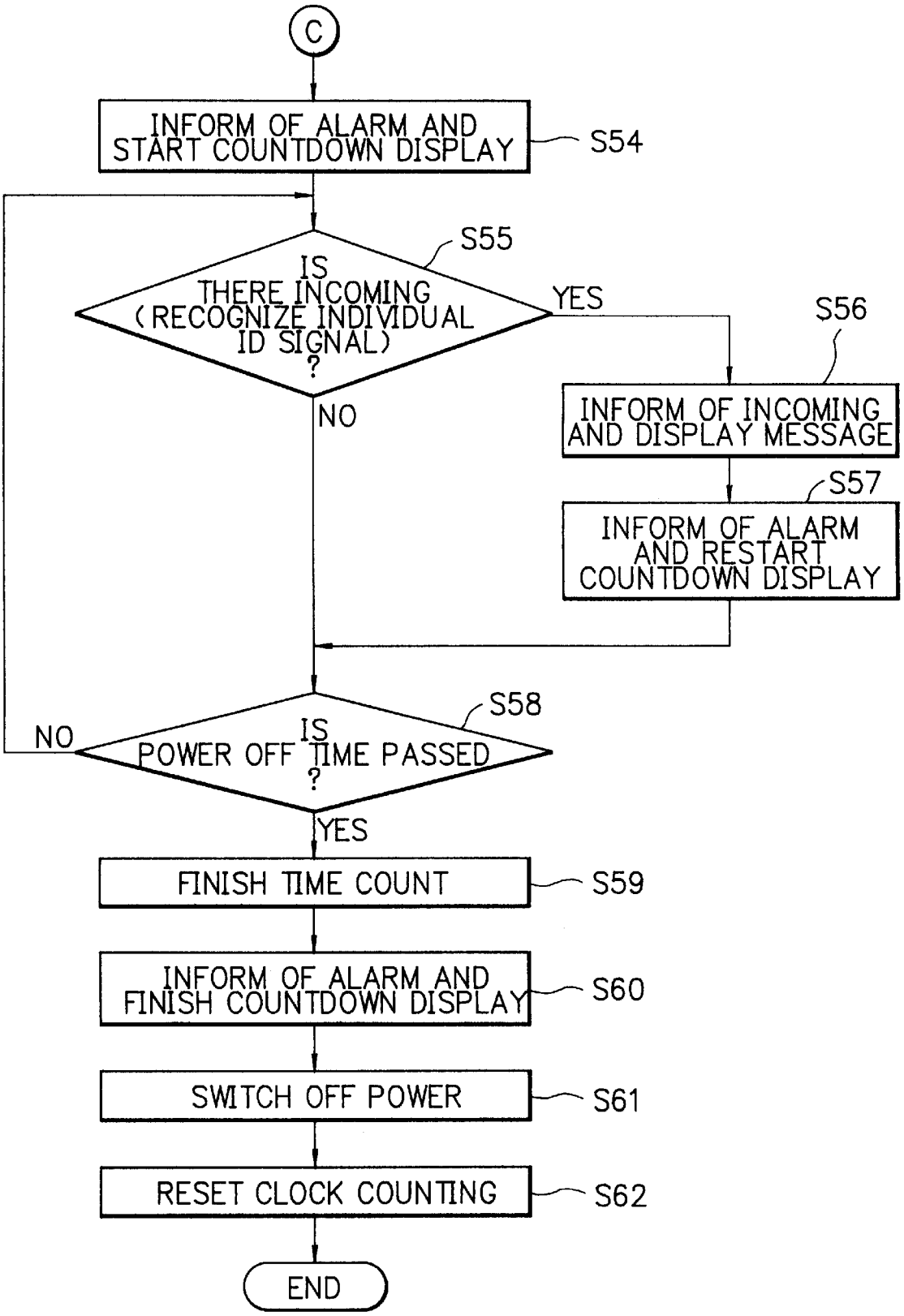

An operation of the radio paging receiver described above will be described in connection with FIGS. 10 and 11 which show the operation of the receiver started by turning on the power switch.

First, the power switch of the receiver is turned on in step S50, and the low voltage detector 6 starts monitoring of the source voltage Va of the cell 10 and discriminates whether or not the source voltage Va is a low voltage state in step S51. During the normal voltage of the source voltage Va, the discrimination step S51 is repeated.

Thereafter, when the source voltage Va falls below the reference voltage Vb generated by the reference voltage generator 21 due to a power consumption of the cell 10 or another cause such as a trouble, in the low voltage detector 6, the comparator 22 outputs a resulted signal Vc having a low level, and the low voltage detection signal generator 23 outputs a low voltage detection signal Vd to the logic 3 in step S52.

In the logic 3, the CPU 43 detects the low voltage detection signal Vd and makes the clock 47 start the count for counting the time from the detection time of the low voltage state to the power off in step S53. In the time from the low voltage detection time to the power off, the receiver is designed to be guaranteed to operate normally under any condition.

The CPU 43 then commands the informing part 4 to inform the user of the LVA and the display 5 to carry out a countdown display in the remaining time up to the power off in step S54. The informing of the LVA and the countdown display are conducted in the mode previously set by the user, as described above. The logic 3 starts a monitoring of the presence or absence of an incoming of the signal transmitted from the transmitter via the antenna 1 and the radio part 2. That is, the transmission signal sent from the transmitter is received by the antenna 1 and is then demodulated by the radio part 2. Hence, in the logic 3, the decoder 42 decodes the demodulated signal and compares the individual ID signal included in the demodulated signal with the individual ID numbers stored in the ROM 41. When these two members are coincident with each other, the decoder 42 outputs the incoming signal to the CPU 43.

The CPU 43 discriminates whether or not there is the incoming of the signal in step S55. Even in the execution of the countdown up to the power off, when there is the incoming, the CPU 43 informs of the incoming as usual, and, when a message is transferred from the decoder 42, the CPU 43 commands the display 5 to display this message in step 56. That is, the CPU 43 controls the incoming alarm informing signal generator 45 to generate an incoming informing signal and the informing part 4 to inform the user of the incoming or the radio paging, and, when there is the message, the CPU 43 outputs the message to the display 5 to display the message therein and stores the message into the RAM 44.

The messages stored in the RAM 44 in this manner can be read out properly by operating the second and third switches 8 and 9 by the user. That is, by pushing down these switches 8 and 9, the CPU 43 read the message specified by the switching operation out of the RAM 44 and outputs the readout message to the display 5 for displaying the same.

Thereafter, when a predetermined time lapses, the CPU 43 controls the clock 47 to restart the countdown display of the remaining time on the display 5 and to restart the alarm informing in step S57.

On the other hand, when there is no incoming in step S55 or the incoming processing in steps S56 and S57 is completed, the CPU 43 discriminates by the clock 47 whether or not a predetermined time of the power off is passed in step S58. When the time up to the power off is not passed, the process is returned to step S55 to carry out the discrimination of whether or not there is the incoming again.

When the predetermined time of the power off is passed in step S58, the CPU 43 finishes the counting of the clock 47 in step S59. The CPU 43 then controls the informing part 4 to inform of the finish of the remaining time countdown and makes the display 5 display this finish therein in step S60. The CPU 43 further instructs a well-known power source controller (not shown) to turn off the power compulsorily in step S61. The CPU 43 then resets the clock count processing in step S62 so as to prevent the restart of the countdown up to the power off at the time when the user exchanges the cell and turns on the power again.

On the other hand, when the user turns off the power by operating the power switch or removes the cell for exchanging the cell in the middle of the countdown in steps S55 to S58, these operations are detected by a well-known power-off detection means, and, while operating by a backup power source (not shown), in the same manner as described above, resets the clock count processing so as to prevent the restart of the countdown after the restart of the power.

As described above, according to the present invention, when a fall of a power voltage is detected, a time counting of the predetermined time is carried out from the detection of the voltage drop, and a power source is cut in the case that the power source is not turned off after passing the predetermined time or the power source is not removed for exchanging the power source, and the power source is still in a low voltage state. As a result, the problems, for example, an inoperative receiving due to the power source voltage drop is caused, and a backup of the received information is cleared, can be prevented effectively.

In the receiver of the present invention, at the detection time of the power source voltage drop, a user is informed of the time until the power source is cut, and the user can be informed of an exact power source exchange period. Further, an intense impact can be given to the user to stimulate the user to exchange a cell and to prevent a negligence of the cell exchange.

In the receiver of the present invention, the user is informed of the remaining time until the power source is cut, and an intense impact can be given to the user to stimulate the user to exchange a cell and to prevent a negligence of the cell exchange.

Moreover, in the receiver of the present invention, in a display range specified from the outside, the remaining time up to the power source cut is displayed, and the informing of the remaining time can be implemented for the convenience of the user.

Furthermore, in the receiver of the present invention, the user is informed of the voltage drop according to a time interval specified from the outside and an informing means, and an alarm informing of the power source voltage drop can be done for the convenience of the user.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A radio paging receiver with a display, comprising:

low voltage detecting means for detecting a voltage drop of a power source;

alarm means for alarming when the voltage drop of the power source is detected;

time counting means for counting time of a clock;

time counting control means for making the time counting means start the time counting when the voltage drop of the power source is detected and for detecting a predetermined time lapse from the start of the time counting; and power source control means for cutting the power source when the predetermined time lapse is detected in the case that the power source is not turned off and is not removed.

2. A radio paging receiver of claim 1, further comprising first informing means for informing of a value of the predetermined time when the voltage drop of the power source is detected.

3. A radio paging receiver of claim 1, further comprising:

calculating means for calculating remaining time before the predetermined time lapse on the basis of the time counted by the time counting means; and second informing means for informing of the remaining time.

4. A radio paging receiver of claim 2, further comprising:

calculating means for calculating remaining time before the predetermined time lapse on the basis of the time counted by the time counting means; and second informing means for informing of the remaining time.

5. A radio paging receiver of claim 3, wherein the second informing means displays the remaining time on a display means within a display range specified from outside.

6. A radio paging receiver of claim 4, wherein the second informing means displays the remaining time on a display means within a display range specified from outside.

7. A radio paging receiver of claim 4, further comprising:

third informing means for informing of an alarm of the voltage drop of the power source from the time of the voltage drop detection every predetermined time interval, the third informing means carrying out the alarm informing according to a time interval specified from outside and a specification of informing equipment.

8. A radio paging receiver of claim 2, further comprising:

third informing means for informing of an alarm of the voltage drop of the power source from the time of the voltage drop detection every predetermined time interval, the third informing means carrying out the alarm informing according to a time interval specified from outside and a specification of informing equipment.

9. A radio paging receiver of claim 3, further comprising:

third informing means for informing of an alarm of the voltage drop of the power source from the time of the voltage drop detection every predetermined time interval, the third informing means carrying out the alarm informing according to a time interval specified from outside and a specification of informing equipment.

10. A radio paging receiver of claim 4, further comprising:

third informing means for informing of an alarm of the voltage drop of the power source from the time of the voltage drop detection every predetermined time interval, the third informing means carrying out the alarm informing according to a time interval specified from outside and a specification of informing equipment.

11. A radio paging receiver of claim 5, further comprising:

third informing means for informing of an alarm of the voltage drop of the power source from the time of the voltage drop detection every predetermined time interval, the third informing means carrying out the alarm informing according to a time interval specified from outside and a specification of informing equipment.

12. A radio paging receiver of claim 6, further comprising:

third informing means for informing of an alarm of the voltage drop of the power source from the time of the voltage drop detection every predetermined time interval, the third informing means carrying out the alarm informing according to a time interval specified from outside and a specification of informing equipment.

* * * * *